US005142845A

United States Patent [19]

Maclauchlan

[11] Patent Number: 5,142,845

[45] Date of Patent: Sep. 1, 1992

[54] CIGARETTE BOX ENDCAP INSERTION METHOD AND APPARATUS

[75] Inventor: Victor L. Maclauchlan, Chester, Va.

[73] Assignee: Philip Morris Incorporated, New York, N.Y.

[21] Appl. No.: 567,808

[22] Filed: Aug. 15, 1990

[51] Int. Cl.[5] ..... B65B 7/28; B65B 19/02; B31B 11/06

[52] U.S. Cl. ..... 53/489; 53/305; 53/310; 493/89; 493/102

[58] Field of Search ..... 493/84, 89, 102; 53/489, 284, 305, 310, 312, 319

[56] References Cited

U.S. PATENT DOCUMENTS

| | | | |
|---|---|---|---|
| 3,659,505 | 5/1972 | Wasyluka et al. | 493/102 |
| 3,967,543 | 7/1976 | Seragnoli | 93/36.01 |
| 4,596,542 | 6/1986 | Moen | 493/89 |
| 4,964,260 | 10/1990 | Focke et al. | 493/102 |

*Primary Examiner*—William E. Terrell
*Attorney, Agent, or Firm*—Ronald A. Krasnow

[57] ABSTRACT

A method and apparatus for inserting one or more endcaps into the ends of a cigarette box using a slide to hold and guide the cigarette box through the apparatus along a predetermined path. Along the path, the box is aligned and endcaps are pushed along a guide rail to guide the endcaps into the ends of the cigarette box. A uniform box with a desired cross-sectional shape is produced.

19 Claims, 5 Drawing Sheets

CIGARETTE BOX ENDCAP INSERTION METHOD AND APPARATUS

BACKGROUND OF THE INVENTION

This invention relates to a method and apparatus to cap one or both ends of a cigarette box. More particularly the invention relates to a method and apparatus to simultaneously insert caps on to the ends of a cigarette box.

Cigarettes are typically sold in packs of twenty to twenty-five cigarettes. Two types of packs are in general use. The first type is a soft pack which is a bundle of cigarettes wrapped in foil, overwrapped with a paper which usually has brand and other information printed on its outer side, and overwrapped again with a sealed polypropylene layer. The second type is a box which is a hard, paperboard box containing a foil wrapped cigarette bundle and having a hinged lid at the top. Typically, a paperboard insert surrounds the bundle at least near the top of the box providing a frictional engagement surface to retain the lid in the closed position when desired. A cutout in this insert allows a smoker to remove cigarettes from the box. This second type of pack is also overwrapped with a sealed polypropylene layer.

Many smokers prefer a hinged top box, which can be reclosed to prevent loose tobacco from dropping out, and which offers better protection for the cigarettes within it. However, the typical cigarette hinged top box has hard corners which are necessary for the box to hold its shape. In addition, current hinged top box designs only allow for an angular shape profile and generally have imperfect miter alignment between the top and the body.

The use of an endcap or endcaps in a hinged cigarette box allows for the box to be aligned into a variety of shapes with proper miter alignment between the top and the body. The endcap in part helps provide support for the shape of the cross-sectional area of the cigarette box. Further, the endcap prevents loose tobacco from falling out of the hinged top box. Therefore, it is important to provide a method and apparatus for inserting one or both endcaps into one or both ends of a cigarette box.

However, the endcap cannot simply be forced into one or both ends of the box. Proper alignment of the endcap with the cigarette box is necessary to provide quality and uniformity of appearance of the cigarette box. In cases where the cigarette box is skewed, bowed or nicked, before one or both of the endcaps can be inserted, the box may have to be realigned to prevent the box's edges from being crushed upon attempted insertion. This realignment can bring the cigarette box back to its original cross-sectional shape. Finally, the endcap should be inserted in a manner which does not damage the endcap's function or appearance, e.g., by physically damaging or marring the endcap with scratches or the like.

SUMMARY OF THE INVENTION

In view of the above, it is an object of this invention to provide a method and apparatus for inserting an endcap into the end of a cigarette box.

It is another object of the invention to provide a method and apparatus for inserting an endcap into both ends of a cigarette box. More specifically this object is to insert endcaps into both ends of a cigarette box simultaneously.

It is yet another object of the invention to provide a method and apparatus for inserting endcaps into cigarette boxes of various cross-sectional shapes.

It is still another object of the invention to provide a method and apparatus for inserting endcaps into the ends of a cigarette box that is capable of gradually merging an endcap into said end to avoid damage or marring of the endcap or of the box.

It is a further object of the invention to provide an endcap insertion method and apparatus that is capable of realigning a cigarette box during endcap insertion to bring the box back to its desired cross-sectional shape.

In accordance with the invention, these and other objects, which will be apparent to one of ordinary skill in the art, are fulfilled by an overall assembly wherein a slide mechanism supports a cigarette box into which endcaps will be inserted. The slide mechanism is located at the end of one, but preferably between two endcap hoppers which supply endcaps to the assembly. Rotatably attached to the slide mechanism is an endcap pusher which engages the endcap at the hopper and pushes it along an endcap guide. As the slide mechanism is moved from its starting point, the cigarette box is forced into its original dimension. Simultaneously, the endcap is gradually inserted into the cigarette box by the guide means as the slide moves along a predetermined path.

After the endcap has been inserted, the slide comes to the end of its path and the completed cigarette box is removed from the assembly. When the slide mechanism returns to the start of its path the endcap pusher pivots out of the way of the frontmost endcap waiting in the hopper.

The endcap guide can be one, but is typically two guide rails which converge on the slide mechanism holding the cigarette box. The endcap guide mechanism is also comprised of a spring, which holds the endcap in an upright position after the endcap has left the hopper and a guide wheel, to seat the endcap into the box. The guide wheel is located at the point of highest friction between the endcap and the endcap guides. The wheel reduces the frictional drag on the endcap thereby making the process smoother and preventing the endcaps from becoming scratched when they are inserted by the wheel into the side of the cigarette box.

Finally, the endcap pushers are rotatably attached to the slide mechanism. This allow the pushers to pivot out of the way of the frontmost endcap waiting in the hopper. Because the endcaps can only be removed by being pushed forward, when the pushers are pulled back into position along with the slide mechanism, the endcaps force the pushers to rotate out of the way.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTION OF THE PREFERRED EMBODIMENT

Figure 1:
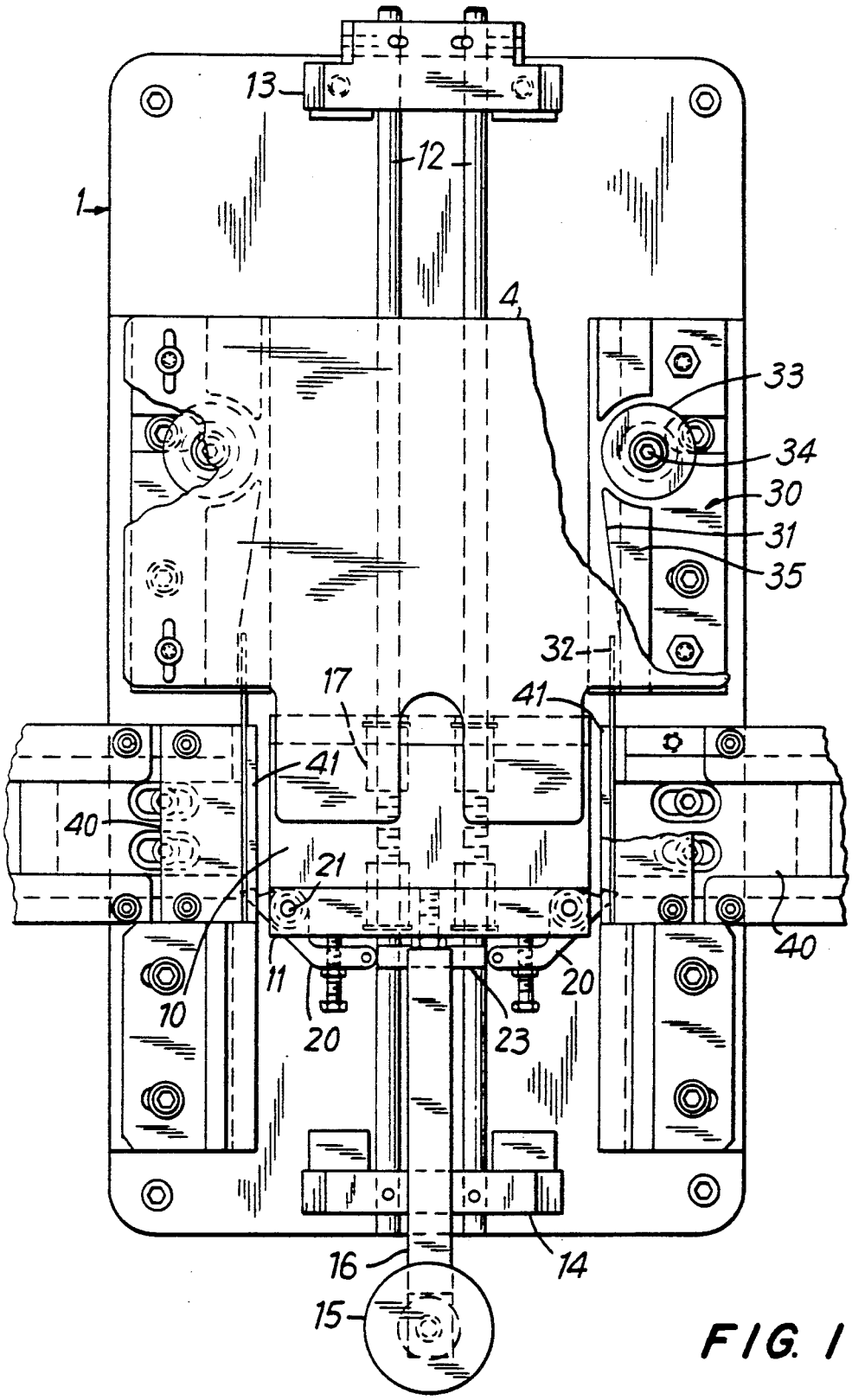
FIG. 1 is a schematic top view of the apparatus of this invention.
Figure 4:
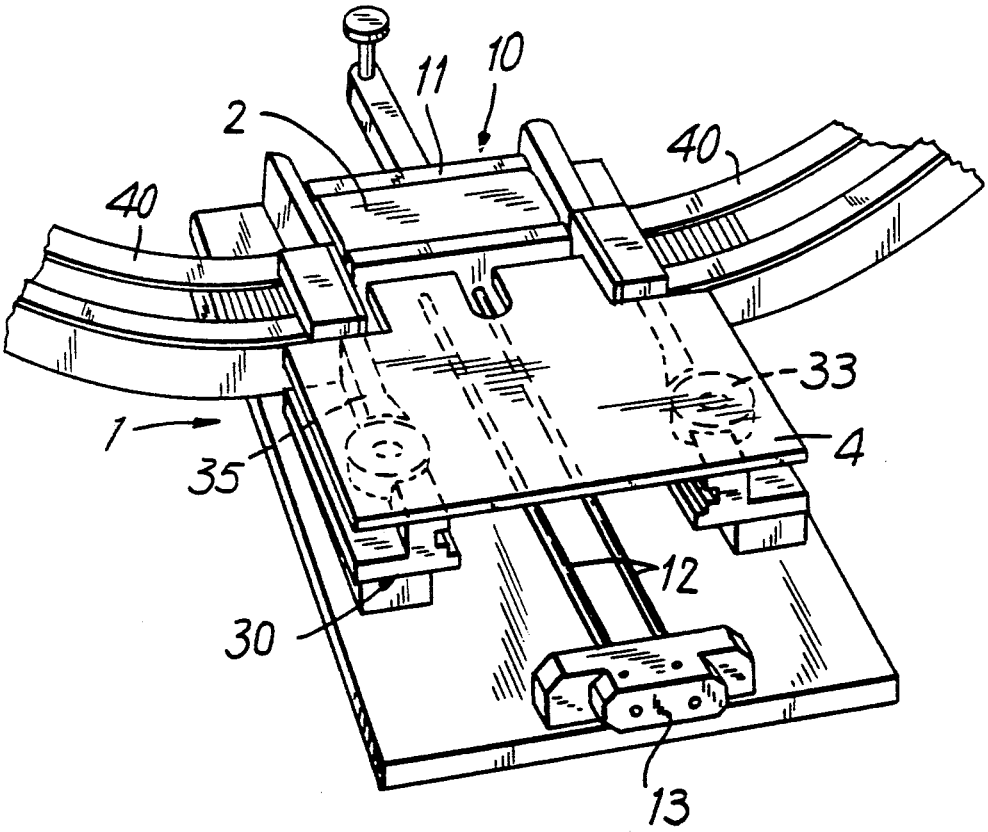
FIG. 4 is an angled view of the overall mechanism.

A preferred embodiment of the endcap insertion apparatus of the present invention is shown in FIGS. 1 and 4. In both of these drawings, an overall assembly 1 is shown having a cigarette box conveying means comprised of a slide means 10, an endcap conveying means comprised of a pusher means 20 and a hopper 40, and a guide means 30. The overall assembly 1 also has a top plate 4 to enclose the guide means 30 and to force the top of a cigarette box 2 into its desired shape. Note that the top plate 4 is not necessary to the proper functioning of the overall assembly 1. One of ordinary skill in the art can develop other methods for forcing a cigarette box to assume a desired shape. The top plate 4 can be made of any material having sufficient properties to perform the described function. Preferably, the top plate is made of metal or a resilient plastic. Most preferably, the top plate is metal with a very smooth finish to avoid scratching the cigarette box when it passes under the top plate.

As shown in FIG. 1, the overall assembly 1 includes a slide means 10. The slide means 10 is used to slide the cigarette box 2 along a predetermined path through the overall assembly 1. A cigarette box is placed onto a slide 11. The slide 11 supports the underside of the cigarette box as it travels through the overall assembly 1 and is forced into a desired shape by the top plate 4. In this manner, both the top and bottom of the cigarette box are controlled allowing easier insertion of endcaps 3. The slide is typically sized to hold only one cigarette box. However, another embodiment encompasses a slide capable of holding several cigarette boxes in succession or several cigarette boxes with each stacked on top of the other. Further, the slide can be shaped to follow a desired cross-sectional area for the cigarette box. For example, if the cigarette box is desirably oval shaped, then the slide can be similarly oval shaped to help the box conform to the desired shape upon sliding past the top plate.

The slide 11 travels through the overall assembly 1 supported by one or more slide shafts 12 using slide bearings 17. The slide bearings 17 allow the slide 11 to move smoothly along the slide shafts 12. The slide bearings 17 preferrably utilize a linear ball bearing mechanism. The slide shafts 12 are located on an axis extending from one end of the overall assembly 1 to the other as shown in FIG. 1. The slide shafts 12 are preferably metal, most preferable stainless steel, however any material with suitable properties will suffice. The slide shafts 12 also control the path of the slide 11 through the apparatus. Each end of the slide shafts 12 is attached to the overall assembly 1 by a bumper 13 and 14. There is an end bumper 13 which is located at the end of the path and a return bumper 14 located at the start of the path. Each bumper 13, 14 stops the slide 11 at one end of the path along the slide shafts 12.

The slide 11 is operated using a slide handle 15 attached to the slide 11 by a slide handle rod 16. The slide handle 15 is used by an operator to move the slide 11 along the slide shafts 12 through the overall assembly 1. While a manual operation is preferred, it is apparent that one of ordinary skill in the art could redesign the slide means 10 such that it was an automated system. For example, another embodiment might entail a series of slides running through the overall assembly in a conveyor manner known to those skilled in the art. This embodiment is not shown in the drawings, but would allow for elimination of the slide shafts 12, the bumpers 13 and 14, the slide sleeves 17, the slide handle 15 and the slide handle rod 16. These pieces could be replaced by a series of slides running in a continous manner past the hoppers, pushing the endcaps out of the hoppers, along the guide means and into the cigarette boxes already on the slides.

Attached to the slide 11 is a means for pushing endcaps 3 from the hopper 40 along the guide means 30. This pusher 20 is attached to the slide 11 using a pusher pin 21 such that the pusher 20 can pivot with respect to the slide 11. Since it is attached to the slide 11, the pusher 20 moves through the overall assembly 1 along the same path as the slide 11. The pusher 20 is located on the slide 11 such that when an endcap 3 is pushed from the hopper 40, the endcap 3 is aligned with the end of the cigarette box.

Figure 2:
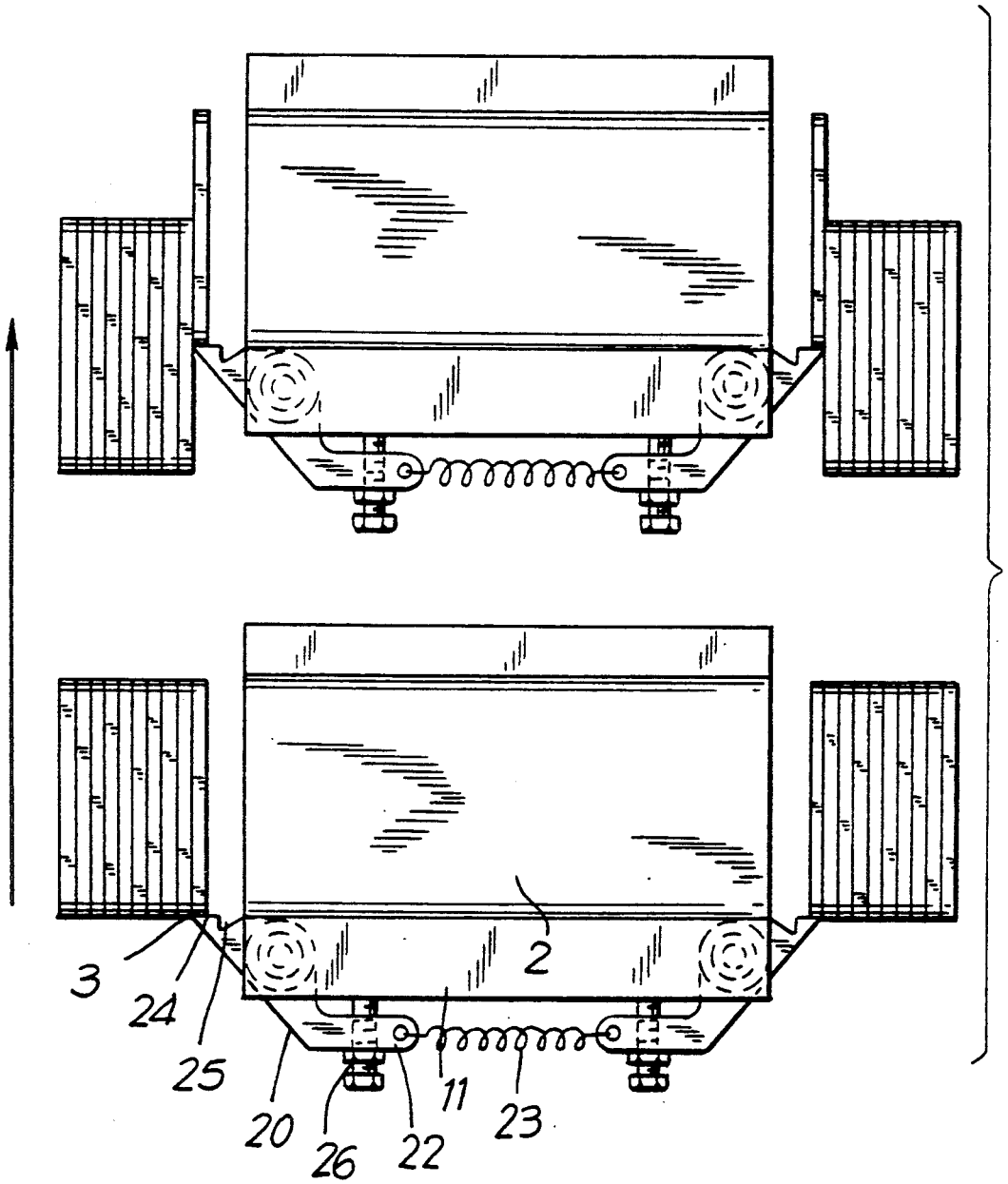
FIG. 2 is an enlarged view of an endcap pusher traveling from the start of its path.
Figure 3:
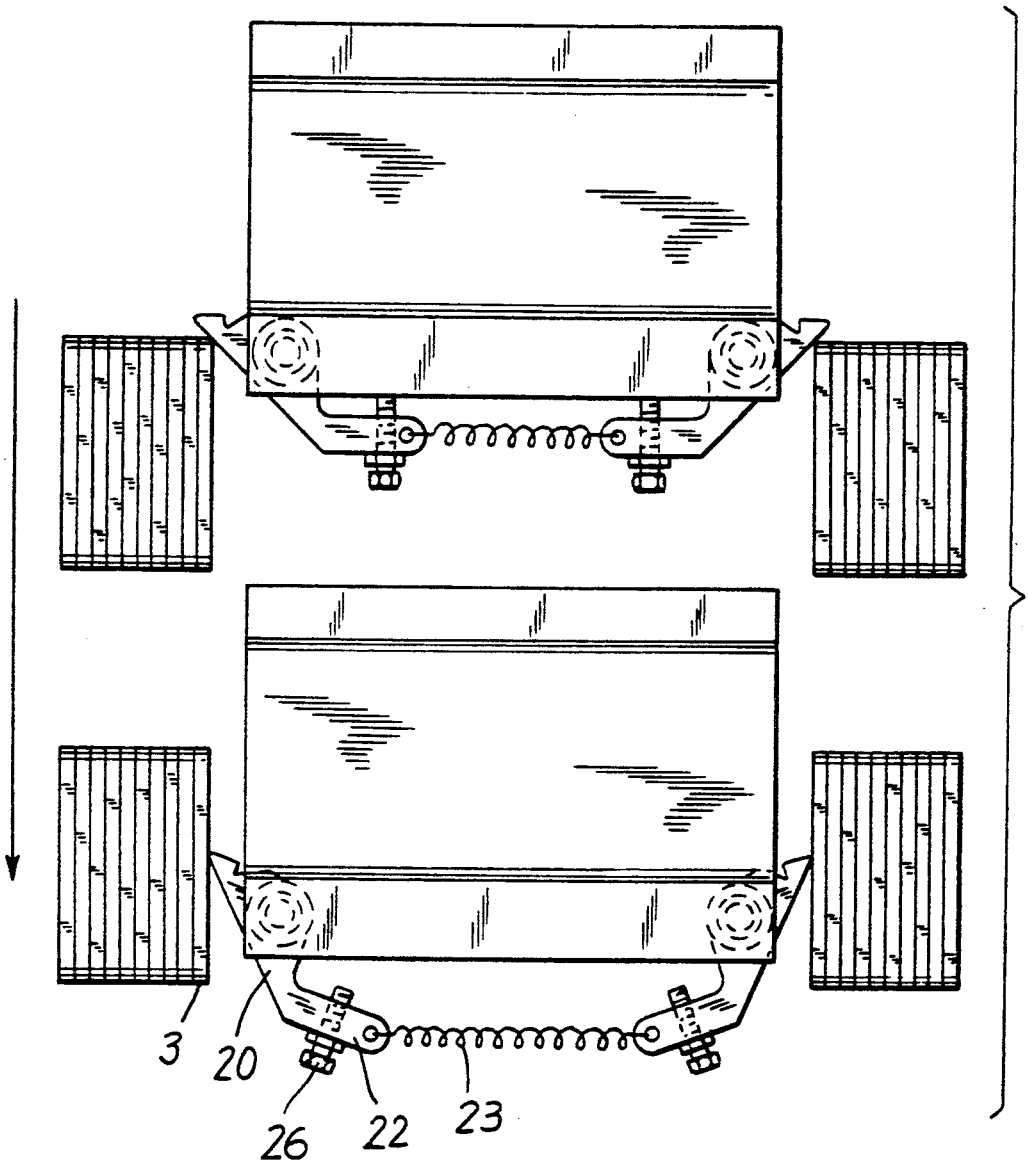
FIG. 3 is an enlarged view of an endcap pusher returning to the start of its path.

Referring now to FIGS. 2 and 3, the structure and operation of the pusher 20 is more fully described. FIG. 2 shows that the pusher 20 has a front face 24 which engages the endcap 3. The front face 24 is preferably made of a material or covered with a material which will not scar or otherwise damage the endcap 3. When the slide 11 is moved forward, an endcap 3 is pushed from the hopper in alignment with the cigarette box 2. The pusher 20 also has a cutout portion 25 which allows the endcap 3 to be inserted into the cigarette box 2 without interference from the pusher 20. Interference may occur because the preferred endcap embodiment has a lip which overhangs the cigarette box.

Also shown in FIGS. 2 and 3 is the fact that the pusher 20 is rotatably attached to the slide. This rotation allows the pusher 20 to pivot about the pusher pin 21. The pivot is controlled by a pusher arm 22 attached to a pusher control spring 23 and to a pusher stop means 26. In FIG. 2 it is shown that when the pusher 20 is moving forward, the front face 24 of the pusher 20 engages the endcap 3 and the pusher 20 rotates about the pusher pin 21 until the pusher stop means 26 contacts the slide 11 and stops the pivot. The pusher 20 stops rotating and is thus able to force an endcap 3 out of the hopper. The pusher stop means 26 is preferably a nut and screw mechanism attached to the pusher arm 22, but can be any mechanism which stop the pivot of the pusher 20. Also preferably, the pusher means 26 is adjustable allowing the pusher 20 to engage an endcap at a desired angle giving the pusher a desired position with respect to the endcap.

When the endcap 3 has been inserted into the cigarette box 2, the pusher 20 pivots during the slide's 11 return to the starting position to remove itself from interfering with the frontmost endcap waiting in the hoppers. In FIG. 3 it is shown that the pushers 20 pivot to avoid the endcaps. The return pivot occurs because the endcaps can be removed from the hopper 40 only when being pushed in the forward direction. When the pusher is being returned to the starting point, the pusher 20 makes contact with the frontmost endcap waiting in the hopper 40. The endcap 3 forces the pusher 20 out of the way, thereby causing the pivot, until the pusher has cleared the frontmost endcap waiting in the hopper. When the pusher 20 has cleared the endcap 3, the pusher control spring 23 recoils therby moving the pusher back to its original position.

The pusher 20 engages an endcap 3 and pushes the endcap along a guide means 30. The guide means 30 serves to guide the endcap 3 into the end of the cigarette box 2. As shown in FIG. 1, the guide means 30 is physically located on the side of the slide means 10 such that the slide means 10 passes in front of the guide means 30.

The first part of the guide means 30 to engage the endcap 3 is the guide spring 32 shown in FIG. 1. Once the endcap 3 is free from the support of the hopper 40, the guide spring 32 supports the endcap 3 in an upright position between itself and the front face 31 of a guide rail 35 until the endcap 3 is pushed into actual contact with the cigarette box 2. The guide spring 32 must be of sufficient length to allow the endcap 3 to engage the cigarette box 2 or the endcap 3 could fall out of alignment with the cigarette box 2 thereby preventing insertion into the box and causing damage to the box and the endcap. The guide spring 32 can be made of any material which will not harm or scratch the endcap. Preferably the guide spring is metal or metal coated with a substance to protect the endcap.

After the endcap 3 has engaged the cigarette box 2 the pusher 20 continues to push the endcap along the guide rail 35. The guide rail 35 is preferably a metal plate or any other material preferably coated with a substance to prevent harm to the endcaps. Each guide rail 35 extends from the hopper 40 to the end of the overall assembly 1. After the endcap 3 passes the guide spring 32, the endcap 3 is pushed along the guide rail's front face 31. The front face 31 converges on the path of the slide means 10 gently inserting the endcap 3 into the cigarette box 2. While any angle of convergence sufficient to gently insert the endcap will be appropriate, the preferred angle is about 3°–35°, more preferably about 4°–15° and most preferably 7°.

As the guide rail's front face 31 converges on the cigarette box's path to insert the endcap 3, at the point of highest friction between the endcap 3 and the front face 31, a guide wheel 33 is preferably provided. The guide wheel 33 pivots about its own axis 34 with its outer edge aligned with the convergence angle of the guide rail's front face 31. In this manner, the angle of convergence is maintained while the friction caused by the endcap being inserted is minimized. With the friction minimized, the chance of damaging or scratching the endcaps 3 is also minimized. The guide wheel 33 is also made of any material with properties sufficient to perform the above described task. Preferably, the guide wheel 33 is either plastic or metal coated with a material to avoid scratching or damaging the endcap.

Endcaps 3 are delivered to the overall assembly 1 using a hopper 40. The hopper 40 supports the endcaps 3 prepared for insertion using a hopper support 41. The endcaps move through the hopper toward the insertion means preferably through the force of gravity because the hopper 40 is preferably angled downward towards the overall assembly 1. Other means for advancing the endcaps 3 in the hopper 40 will be apparent to one of skill in the art, e.g., conveying means.

Figure 5:
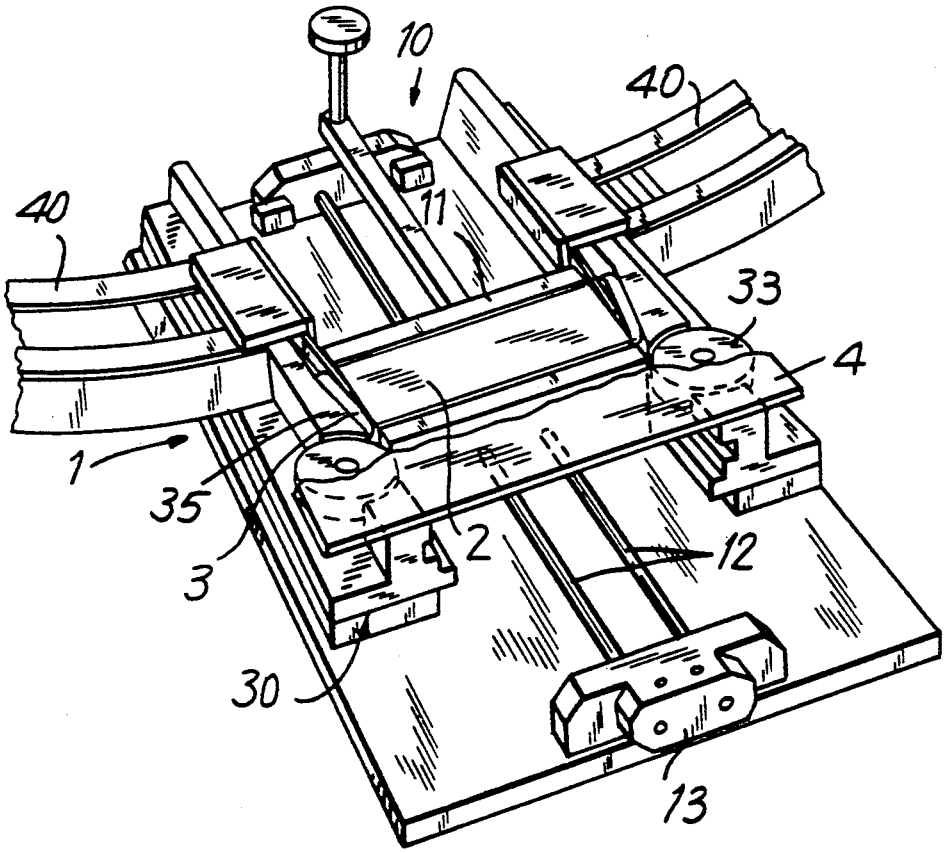
FIG. 5 is a perspective view of the overall mechanism showing an endcap entering each end of a cigarette box.

The method of operation is preferably as follows. A cigarette box 2 is placed on the slide 11 such that its ends face the hopper 40. An operator pushes the slide handle 15 moving the slide 11, the cigarette box 2 and the pusher means 20 forward. The pusher 20 engages the frontmost endcap 3 in the hopper and, as the slide means 10 is pushed forward by the operator, the endcap is aligned with and inserted into the end of the cigarette box by the guide means 30. As shown in FIG. 5, the endcap 3 is pushed along the guide rail 35 such that it is aligned with the cigarette box 2, which is riding in slide 11. As the guide rail 35 converges on the path the cigarette box follows the endcap 3 also converges on the cigarette box 2, and is inserted into the end of the cigarette box. This takes place as the slide 11 is pushed along the slide shafts 12 to the end bumper 13. After the endcaps 3 have been inserted and the slide means is up against the end bumper 13 the completed cigarette box with endcaps is removed and sent on for further processing. The slide means 10 is returned to its original starting position, up against the return bumper 14 using the slide handle 15. Note that on the return path, the pusher means 20 pivots around the frontmost endcap waiting in the hopper 40.

As noted previously, while the preferred embodiment is a manual process, another embodiment is an automated process where the method of placing the cigarette box on the slide means is by an automatic conveyor. Further the slide means can be automated to allow the pushing and pulling of the slide means to be automatic or to have a conveyor carry the slide or a series of slides through the insertion process. Also, the completed box removal process can be automatic by use of a conveyor or another pusher belt. Note finally that the endcaps may be of any cross-sectional shape desired and may be made of any material with the properties required to allow proper functioning of the endcap. Preferably the endcap is made of metal or plastic. Most preferably the endcap is made of polyethylene. In a most preferred embodiment, the endcap is oval approximately 1.7 inches long, 0.63 inches wide and 0.05 inches thick.

It will be understood that the foregoing is merely illustrative of the principles of this invention. Modifications by those skilled in the art, without departing from the scope and spirit of the invention, will be apparent. The present invention is limited only by the claims which follow.

What is claimed is:

1. An apparatus for inserting an endcap into an open end of a cigarette or like box, comprising:

slide traveling along a slide means defining a predetermined path, said slide having an area adapted to hold said box with the ends of said box parallel with said slide means, a pusher pivotably secured on said slide, said pusher being located at a corner of said slide and behind said area of said slide adapted to hold said box, said pusher having a front face extending beyond a side of said slide, a hopper, located at a side of said slide means, said hopper being adapted to hold said endcaps available at the side of said path, and a guide rail extending along at least a portion of a side of said slide means, and located after said hopper along said path, said guide rail having a front face converging on said path at an angle of convergence sufficient to insert said endcap into an end of said box, wherein:

as said slide travels along said slide means, said pusher front face engages a frontmost endcap from said hopper and pushes it along said guide rail front face such that said endcap converges on said path and is inserted into the end of said box being held by said slide.

2. The apparatus of claim 1, wherein said pusher further comprises an arm lying in the same plane as said front face, and extending in a direction opposite from said front face.

3. The apparatus of claim 2, wherein there are at least two pushers rotatably attached to said slide, with a first pusher located in one rear corner of said slide and a second pusher located in the other rear corner of said slide.

4. The apparatus of claim 3, wherein said first pusher has a first arm extending toward the center line of said slide and said second pusher has a second arm extending toward the center line of said slide, said first and second arms are connected with a spring biasing said first and second arms towards each other and biasing said first and second front faces over a side end of said slide.

5. The apparatus of claim 4, further comprising an adjustable pusher stop means attached to each of said first and second arms that controls the amount of extension of said first and second front faces respectively over the side end of said slide.

6. The apparatus of claim 1, wherein said slide means comprises at least on slide shaft extending from one end of said apparatus to the other, with a bumper at each end, and at least one slide sleeve attached to the bottom of said slide supporting said slide on said shaft.

7. An apparatus for inserting an endcap into an open end of a cigarette or like box, said apparatus comprising:

a slide traveling along a slide means, said slide means defining a predetermined path, and said slide having an area adapted to hold said box with an end of said box parallel to said slide means, a pusher pivotably mounted on said slide, said pusher being located near a side of said slide such that a front face of said pusher extends beyond the side of said slide, a hopper, located at a side of said slide means, said hopper being adapted to hold one or more endcaps available at the side of said path, and a guide rail extending along at least a portion of a side of said slide means, and located after said hopper along said path, said guide rail having a front face converging on said slide means at an angle of convergence sufficient to insert said endcap into said end of said box, wherein:

said box is placed in said area of said slide adapted to hold said box, and, as said slide travels along said slide means, said pusher front face engages a frontmost endcap from said hopper and pushes it along said guide rail front face such that said endcap converges on said path and is inserted into said end of said box being held by said slide.

8. The apparatus of claim 7, wherein said pusher is located on said slide at a corner of said slide, and behind the area adapted to hold said box.

9. The apparatus of claim 7, wherein said pusher further comprises an arm lying in the same plane as said front face, and extending in a direction opposite from said front face.

10. The apparatus of claim 8, wherein there are at least two pushers pivotably attached to said slide, with a first pusher located in one rear corner of said slide and a second pusher located in the other rear corner of said slide.

11. The apparatus of claim 10, wherein said first pusher has a first arm extending toward the center line of said slide and said second pusher has a second arm extending toward the center line of said slide, said first and second arms are connected with a spring biasing said first and second arms towards each other and biasing said first and second front faces over a side of said slide.

12. The apparatus of claim 11, further comprising an adjustable pusher stop means attached to each of said first and second arms that controls the amount of extension of said first and second front faces respectively over the side of said slide.

13. The apparatus of claim 7, wherein said slide means comprises at least on slide shaft extending from one end of said apparatus to the other, with a bumper at each end, and at least one slide sleeve attached to the bottom of said slide supporting said slide on said shaft.

14. The apparatus of claim 7, further comprising a rotatable guide wheel, located along said path after at least a portion of said guide rail, said guide wheel having an outer edge aligned with the convergence of the front face of said guide rail, wherein:

as said endcap is pushed along said guide rail front face and converges on said path, said endcap engages said guide wheel which rotates to reduce friction as the endcap enters said end of said box.

15. The apparatus of claim 7 further comprising a top plate, said top plate being located above and over at least a portion of said path at an elevation sufficient to allow said top plate to work in conjunction with said area of said slide adapted to hold said box, whereby: as said slide advances along said path, said slide advances under said top plate and said box being held by said slide is forced into a desired cross-sectional shape.

16. The apparatus of claim 1, further comprising a rotatable guide wheel, located along said path after at least a portion of said guide rail, said guide wheel having an outer edge aligned with the convergence of the front face of said guide rail, wherein:

as said endcap is pushed along said guide rail front face and converges on said path, said endcap engages said guide wheel which rotates to reduce friction as the endcap enters the end of said box.

17. A method for inserting an endcap into an open end of a cigarette or like box, comprising the steps of placing said box on a slide that travels along a predetermined path, arranging said box on said slide so that an open end of said box is parallel to said path, delivering an endcap to a side of said path, advancing said slide with said arranged box along said path past said delivery point for said endcap, engaging said endcap with a pusher pivotably attached to said slide, and further advancing said slide and said arranged box, thereby pushing said endcap with said pusher along a front face of a guide rail that converges on said path so that said endcap is inserted into the open end of said arranged box.

18. The method of claim 17 in which said step of advancing said slide is carried out by manually pushing said slide along said predetermined path.

19. The method of claim 18 in which said step of placing said box on said slide is carried out by locating said box on said slide in front of said pivotably mounted pusher.

* * * * *